United States Patent [19]

Beattie et al.

[11] Patent Number: 4,569,294

[45] Date of Patent: Feb. 11, 1986

[54] MEDIA PROTECTION SYSTEM

[75] Inventors: Patrick J. Beattie, Henrietta; Nathan A. Harvey, Holcomb, both of N.Y.

[73] Assignee: John D. Brush & Co., Inc., Rochester, N.Y.

[21] Appl. No.: 644,443

[22] Filed: Aug. 27, 1984

[51] Int. Cl.[4] ..... E05G 1/04

[52] U.S. Cl. ..... 109/45; 109/24; 109/50; 109/57; 49/386

[58] Field of Search ..... 109/22, 24, 45, 50, 109/53, 56, 57, 68, 73, 49, 5, 75, 80, 84; 312/323, 138 R; 49/386

[56] References Cited

U.S. PATENT DOCUMENTS

| | | | |
|---|---|---|---|
| 89,474 | 4/1869 | Fitzgerald | 109/22 |
| 301,797 | 7/1884 | Brintnall | 109/56 |
| 641,868 | 1/1900 | Klingelsmith | 109/22 |
| 1,485,363 | 3/1924 | Bellamore et al. | 109/79 |
| 3,421,461 | 1/1969 | St. Clair et al. | 109/57 |
| 3,559,594 | 2/1971 | Miller | 109/84 |
| 3,762,787 | 10/1973 | Grubb | 109/80 |
| 3,888,557 | 6/1975 | Anderson et al. | 109/80 |
| 4,373,450 | 2/1983 | Miller et al. | 109/75 |

*Primary Examiner*—Kenneth J. Dorner
*Assistant Examiner*—Neill Wilson
*Attorney, Agent, or Firm*—Stonebraker, Shepard & Stephens

[57] ABSTRACT

A media protection system 10 uses a media storage box 20 arranged within a fire resistant safe 11 so that the media box door 25 and the safe door 12 cooperate to seal media box 20 closed and hold it spaced from interior walls of safe 11. Media box door 25 has a roller 30 arranged on a pivot axis 26 spaced forward and below its hinge axis 24 at the lower front of media box 20. The weight of media box 20 and its door 25 resting on door roller 30, which can roll along a horizontal surface of the interior 14 of safe 11, automatically biases safe door 12 to either a fully closed position or a fully open position. An abutment 35 on the inside of safe door 12 presses media box door 25 fully closed and sealed.

11 Claims, 4 Drawing Figures

MEDIA PROTECTION SYSTEM

BACKGROUND

Protective storage for non-paper media such as electromagnetic disks and tapes can be achieved with a media storage box arranged within a fire resistant safe. In a fire, the safe can hold its interior to about the temperature of boiling water, creating a protected environment for the media storage box. Additional insulation and vapor seals in the media box keep its interior at temperatures below 125° F. and relative humidity below 80%, which adequately protects floppy disks and cassette tapes, for example.

We have discovered a simple and effective way of arranging a media storage box within a fire resistant safe, not only to meet the media protection requirements, but also to afford convenient access to the media box. Our combination of features for a media protection system aims at simplicity, economy, and effectiveness, making our system more widely affordable.

SUMMARY OF THE INVENTION

Our media protection system includes a media storage box arranged within a fire resistant safe to be spaced from interior walls of the safe and have a door and a front opening oriented toward a door of the safe. A hinge joins the media box door to a lower front region of the media box, and the door has a roller arranged on an axis spaced forward and below the hinge axis when the media box door is closed. The roller supports the weight of a front region of the media box and its door above a horizontal surface within the safe along which the roller rolls as the media door opens and closes. The roller and media door are arranged so that from a half-closed to a closed position of the media door, the roller axis is forward of the hinge axis so that the weight of the media door and the media box resting on the roller urges the door closed. From a nearly open to a fully open position of the media door, the roller axis is behind the hinge axis so that the weight resting on the roller urges the media door fully open. Other features, including interlocking pivot hooks arranged at the upper rear of the media box and an abutment arranged on the inside of the safe door, ensure full closure of the media box door and holding of the media box in its rest position whenever the safe door is closed.

DRAWINGS

DETAILED DESCRIPTION

Figure 1:
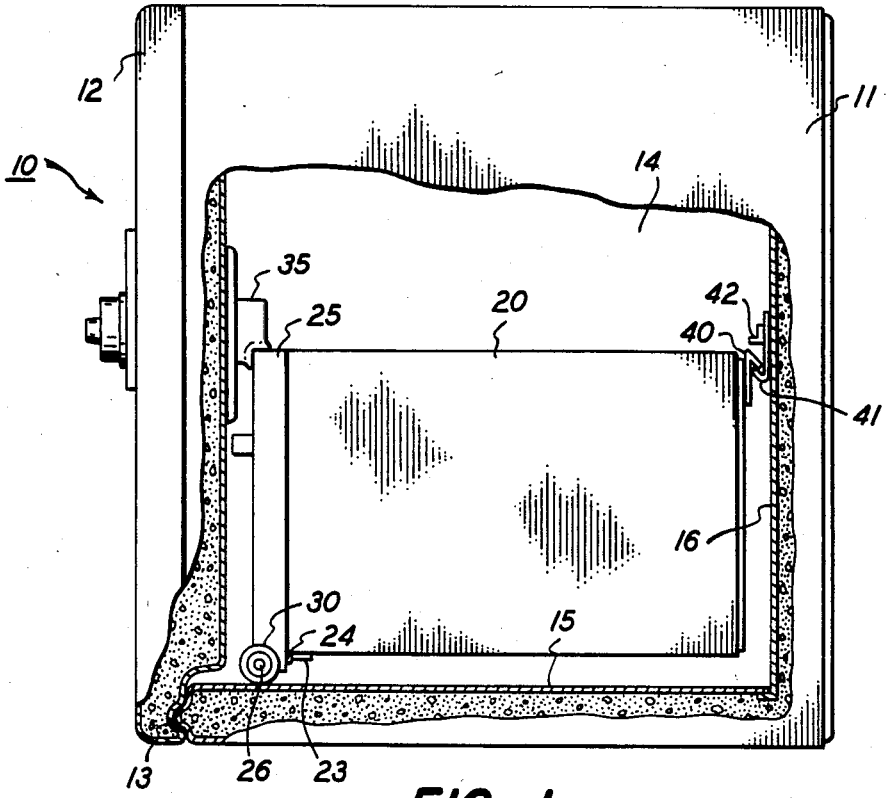
FIG. 1 is a partially schematic and partially cutaway side elevational view of a preferred embodiment of the inventive media protection system, including a media storage box arranged within a fire resistant safe.
Figure 4:
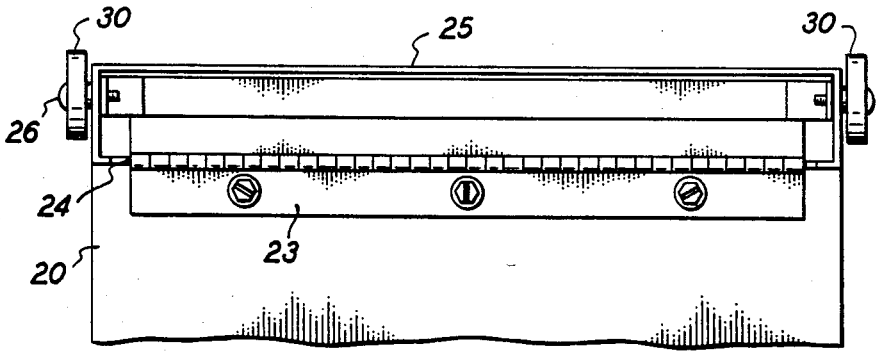
FIG. 4 is a fragmentary bottom view of the front region of the media storage box of FIGS. 1–3.

Our media protection system 10 includes a fire resistant safe 11 having a door 12, a jamb 13 around door 12, and an interior 14. Media storage box 20 fits within safe 11 where, in a rest position as shown in FIG. 1, it is spaced from the surfaces of interior 14, including bottom 15, back 16, door 12, and the unnumbered side and top surfaces of interior 14. A fire around safe 11 slowly heats interior 14 up to the temperature of boiling water.

Media storage box 20 rests in this protected atmosphere spaced at an insulating gap from interior surfaces of safe 11. Media box 20 includes insulation, a heat sink, and a vapor barrier capable of keeping its interior below 125° F. and 80% relative humidity.

The features we have discovered give media box 20 a convenient and reliable door 25 and ensure that media box 20 stays securely in its rest position clear of the interior surfaces.

Door 25 is hinged to the bottom front edge of media box 20 by a hinge 23 having a hinge axis 24. Roller wheels 30, mounted on a bottom region of door 25, turn on a roller axis 26 that is spaced forward and below hinge axis 24 when media door 25 is closed. Roller wheels 30 extend below the bottom and forward of the front of door 25 to rest on the horizontal surface of safe bottom 15 and support the weight of door 25 and the front region of media box 20. As door 25 opens, as shown in FIGS. 2 and 3, roller 30 rolls along safe bottom 15, and media box 20 pivots slightly to accommodate this motion.

Figure 2:
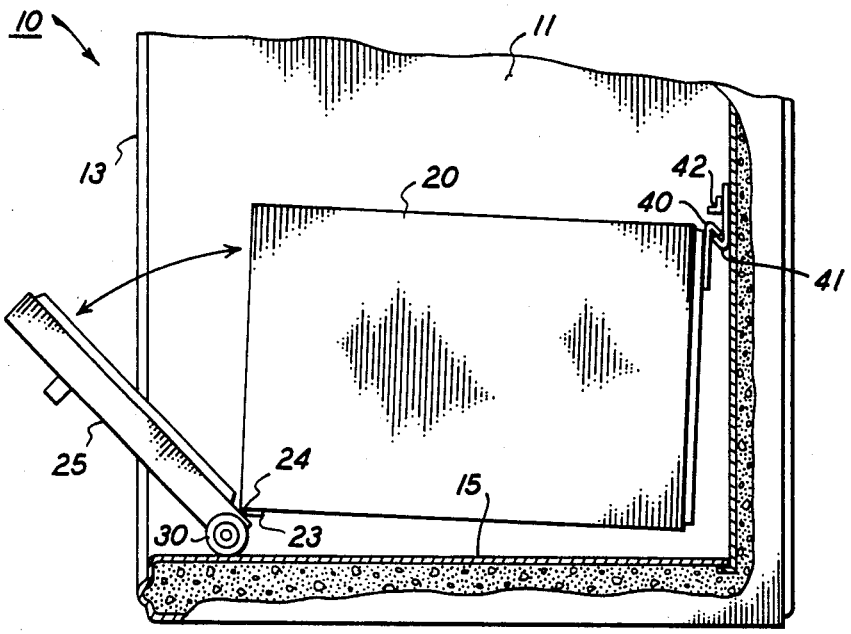
FIGS. 2 and 3 are partially schematic, partially cutaway views similar to the view of FIG. 1, but showing the media box door half-way open and fully open.
Figure 3:
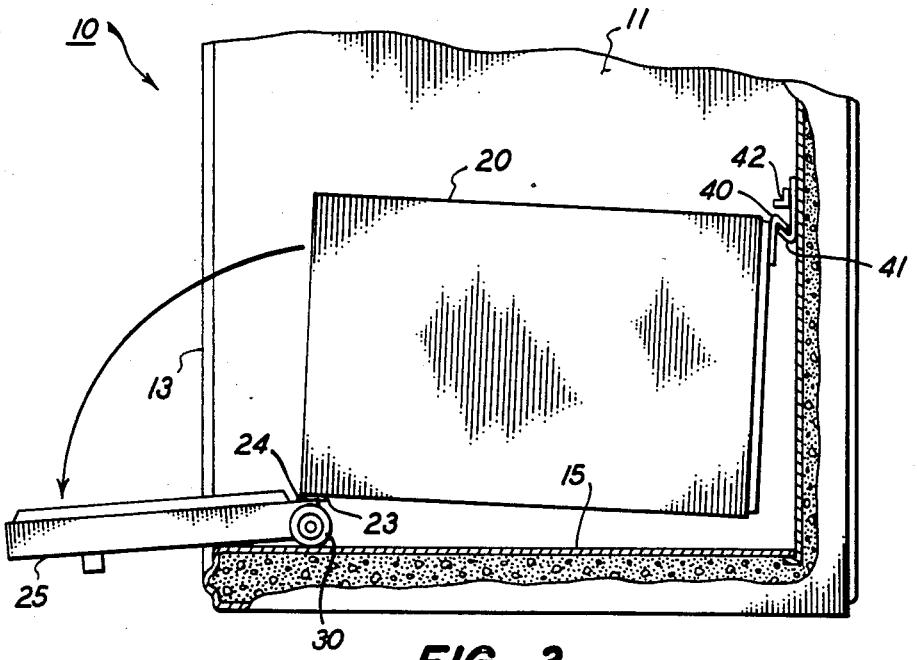

At the half-open position of door 25 as shown in FIG. 2, roller axis 26 is underneath hinge axis 24. From there to the closed position shown in FIG. 1, roller axis 26 moves forward of hinge axis 24 so that the weight of media box 20 and its door 25 resting on roller 30 urges media door 25 closed. As door 25 opens beyond the half-open position of FIG. 2, roller axis 26 moves behind hinge axis 24 where the weight of media box 20 and its door 25 biases door 25 toward the fully open position of FIG. 3.

From a user's point of view, door 25 slightly resists opening and must be pulled open to the half-open position and a little beyond, to where door 25 is biased toward a fully open position. Once door 25 opens far enough, it automatically proceeds to its fully open position of FIG. 3, where it lets the user get into box 20 for removing or inserting media.

To close the system up to protect media stored in box 20, the user lifts door 25 beyond the half-closed position from which door 25 is automatically biased toward the fully closed position of FIG. 1. The closed and open bias of door 25 is achieved by using the weight of door 25 and the forward region of box 20, without requiring springs or other components complicating the construction.

The interior of safe door 12 has an abutment 35 arranged to engage an upper front edge of media door 25 when safe door 12 closes. Abutment 35 is preferably formed of resilient and compressible or deformable material such as synthetic rubber. Abutment 35 can then engage and press media box door 25 tightly closed to seal it against vapor passage. Abutment 35 is also arranged to press downward and rearward on media box 20 to hold media box 20 in the rest position of FIG. 1.

Using abutment 35 on the inside of safe door 12 to ensure an automatic and tight closure of media door 25 when safe door 12 is closed eliminates the need for any latch independently holding door 25 closed. This has the advantage of eliminating any heat-conductive and vapor-leaking mechanisms extending through door 25 to an internal latch within box 20. Door 25 can be made more simply and economically and can also maintain better fire and vapor resistance if it is not penetrated by any latching, locking, or handle mechanism. The automatic biasing of media door 25 to its closed position also cooperates well with safe door 12 and abutment 35, ensuring that media box door 25 is biased closed in the proper position for engagement by abutment 35 when safe door 12 closes.

A downwardly oriented pivot hook 40 at the upper rear of media box 20 engages an upwardly oriented pivot hook 41 secured to interior safe wall 16 to support the rear of media box 20 clear of the interior 14 of safe 11. A guard 42, positioned above hook 41, prevents unlatching of hooks 40 and 41 unless media box 20 moves forward from its rest position toward safe door 12. Abutment 35, engaging the upper front edge of media door 25 when safe door 12 is closed, prevents any forward movement of media box 20 so that guard 42 holds hooks 40 and 41 securely together. Pivot hooks 40 and 41 also accommodate the slight pivoting motion of media box 20 that occurs as door 25 opens and closes.

Media box 20 can be easily installed in safe 11 by engaging hooks 40 and 41 as box 20 is moved rearwardly into safe interior 14. Thereafter, media box 20 is conveniently accessed via automatically biased door 25 and is held securely in its resting position whenever safe door 12 is closed. It is not possible to close safe door 12 without having closed media box door 25, because of its orientation extending out of the front of safe 11 when opened.

We claim:

1. A media protection system including a media storage box arranged within a fire resistant safe and comprising:

a. said media box, in a rest position, being spaced from interior walls of said safe and having a front opening oriented toward a door of said safe;

b. said media box having a door for said front opening;

c. a hinge joining said media box door to a lower front region of said media box where said hinge has a pivot axis;

d. a roller arranged on a bottom region of said door so that said roller has an axis spaced forward and below said hinge axis when said media box door is closed;

e. said roller being arranged for supporting the weight of a front region of said media box and said media door above a horizontal surface within said safe along which said roller rolls as said media door opens and closes;

f. said roller and said media door being arranged so that from a half-closed to a closed position of said media door, said roller axis is forward of said hinge axis so that the weight of said media door and said media box resting on said roller urges said door closed; and g. said roller and said media door being arranged so that from a nearly open to a fully open position of said media door, said roller axis is behind said hinge axis so that the weight of said media door and said media box resting on said roller urges said media door fully open.

2. The system of claim 1 including a downwardly oriented pivot hook arranged along an upper rear region of said media box and an upwardly oriented pivot hook arranged on an inside surface of a rear region of said safe so that said pivot hooks engage to support a rear region of said media box in said rest position clear of said interior walls of said safe.

3. The system of claim 2 including a guard arranged to keep said pivot hooks from unhooking unless said media box moves forward from said rest position toward said safe door.

4. The system of claim 1 including an inward facing abutment on said safe door arranged so that when said safe door is closed, said abutment engages and presses an upper front edge of said media box door tightly closed and holds said media box in said rest position.

5. The system of claim 4 wherein said abutment is formed of resilient and compressible material.

6. The system of claim 1 wherein said roller is formed as a pair of spaced-apart wheels rotatable on said roller axis.

7. The system of claim 6 including a downwardly oriented pivot hook arranged along an upper rear region of said media box and an upwardly oriented pivot hook arranged on an inside surface of a rear region of said safe so that said pivot hooks engage to support a rear region of said media box in said rest position clear of said interior walls of said safe.

8. The system of claim 7 including a guard arranged to keep said pivot hooks from unhooking unless said media box moves forward from said rest position toward said safe door.

9. The system of claim 7 including an inward facing abutment on said safe door arranged so that when said safe door is closed, said abutment engages and presses an upper front edge of said media box door tightly closed and holds said media box in said rest position.

10. The system of claim 9 wherein said abutment is formed of resilient and compressible material.

11. The system of claim 10 including a guard arranged to keep said pivot hooks from unhooking unless said media box moves forward from said rest position toward said safe door.

* * * * *